US011773689B2

(12) United States Patent
Culbertson et al.

(10) Patent No.: US 11,773,689 B2
(45) Date of Patent: Oct. 3, 2023

(54) SURGE FLOW MITIGATION TOOL, SYSTEM AND METHOD

(71) Applicant: ODESSA SEPARATOR, INC., Odessa, TX (US)

(72) Inventors: Daniel L. Culbertson, Odessa, TX (US); Mark H. Lowe, Odessa, TX (US); Cavin B. Frost, Odessa, TX (US); Donovan J. Sanchez, Midland, TX (US); Benjamin Lee Weatherford, Hearne, TX (US)

(73) Assignee: ODESSA SEPARATOR, INC., Odessa, TX (US)

( * ) Notice: Subject to any disclaimer, the term of this patent is extended or adjusted under 35 U.S.C. 154(b) by 106 days.

(21) Appl. No.: 17/405,227

(22) Filed: Aug. 18, 2021

(65) Prior Publication Data

US 2022/0056784 A1 Feb. 24, 2022

Related U.S. Application Data

(60) Provisional application No. 63/068,854, filed on Aug. 21, 2020.

(51) Int. Cl.
*E21B 34/08* (2006.01)
*E21B 34/14* (2006.01)
(Continued)

(52) U.S. Cl.
CPC ..... *E21B 34/08* (2013.01); *E21B 21/103* (2013.01); *E21B 34/10* (2013.01); *E21B 34/14* (2013.01); *E21B 2200/04* (2020.05)

(58) Field of Classification Search
CPC ..... E21B 34/08; E21B 21/103; E21B 34/10; E21B 34/14; E21B 34/142; E21B 2200/04; E21B 33/00
See application file for complete search history.

(56) References Cited

U.S. PATENT DOCUMENTS 6,571,876 B2 * 6/2003 Szarka ..... E21B 21/103 175/218
6,672,387 B2 1/2004 Brady et al.
(Continued)

OTHER PUBLICATIONS

Jacobs, Trent; "Slug-Smoothing Technology Sees Over 200 Shale Installs, Gets Boost From Schlumberger JV", Journal of Petroleum Technology, dated Jul. 2017, 43 Pages.
(Continued)

*Primary Examiner* — Catherine Loikith
(74) *Attorney, Agent, or Firm* — Smith IP Services, P.C.

(57) ABSTRACT

A surge flow mitigation tool can include a surge flow valve that permits one-way fluid flow through a flow passage, and a bypass flow path that opens when a differential pressure across the surge flow valve is greater than a predetermined level. A method of mitigating surge flow in a well can include producing fluid through a tubular string with a bottom hole assembly including a surge flow mitigation tool connected downhole of a packer, the surge flow mitigation tool including a surge flow valve that permits the fluid to flow toward surface via the tubular string, but prevents the fluid from flowing into the well via the tubular string, and increasing a differential pressure across the surge flow valve to greater than a predetermined level, thereby opening a bypass flow path that permits injection flow from the tubular string into the well downhole of the packer.

30 Claims, 8 Drawing Sheets

(51) Int. Cl.
*E21B 21/10* (2006.01)
*E21B 34/10* (2006.01)

(56) References Cited

U.S. PATENT DOCUMENTS

| | | | | |
|---|---|---|---|---|
| 7,093,661 | B2 | 8/2006 | Olsen | |
| 10,364,658 | B2 | 7/2019 | Michel | |
| 10,415,360 | B2 | 9/2019 | Culbertson et al. | |
| 10,508,514 | B1 | 12/2019 | Daniel et al. | |
| 2007/0017679 | A1* | 1/2007 | Wolf | E21B 34/14 166/174 |
| 2014/0305652 | A1 | 10/2014 | Wilson | |
| 2015/0330181 | A1 | 11/2015 | Budde et al. | |
| 2016/0265332 | A1 | 9/2016 | Saponja et al. | |
| 2018/0135383 | A1 | 5/2018 | Romer et al. | |
| 2020/0123888 | A1 | 4/2020 | Saponja et al. | |
| 2020/0157897 | A1 | 5/2020 | Hered | |
| 2020/0208506 | A1 | 7/2020 | Frost et al. | |
| 2020/0217180 | A1 | 7/2020 | Leniek, Sr. | |
| 2020/0240254 | A1 | 7/2020 | Saponja et al. | |
| 2020/0256179 | A1 | 8/2020 | Hari et al. | |

OTHER PUBLICATIONS

Schlumberger; "Heal System Increases Production More Then 75% from 25 Montney Shale Wells", company article, dated 2019, 1 page.

Schlumberger; "Heal System Helps Increase Production Rate 33% by Enhancing Rod Pumping Efficiency", company article, dated 2019, 1 page.

Heal Systems; "Schlumberger and Productions Plus Announce Joint Venture", Business Wire article, dated Jun. 19, 2017, 3 pages.

Journal of Petroleum Technology; "With Over 200 Shale Well Installs, This Slug-Smoothing Lift Technology Is Boosted By Schlumberger JV", article by Trent Jacobs, dated Jun. 14, 2017, 6 pages.

* cited by examiner

SURGE FLOW MITIGATION TOOL, SYSTEM AND METHOD

CROSS-REFERENCE TO RELATED APPLICATION

This application claims the benefit of the filing date of U.S. provisional application No. 63/068,854 filed on 21 Aug. 2020. The entire disclosure of this prior application is incorporated herein by this reference for all purposes.

BACKGROUND

This disclosure relates generally to equipment utilized and operations performed in conjunction with a subterranean well and, in an example described below, more particularly provides a surge flow mitigation tool.

It is generally beneficial to produce well fluids from a well. However, at times it is beneficial to be able to inject fluids into a well. Thus, those skilled in the art have developed a variety of tools, systems and methods for controlling fluid flow in a well.

However, these prior tools, systems and methods do not address a problem associated with surge flow in wells. Therefore, it will be appreciated that improvements are continually needed in the art of controlling fluid flow in a well. It is among the objects of the present disclosure to provide such improvements, which can be useful in a wide variety of different well configurations and operations.

DETAILED DESCRIPTION

Figure 1:
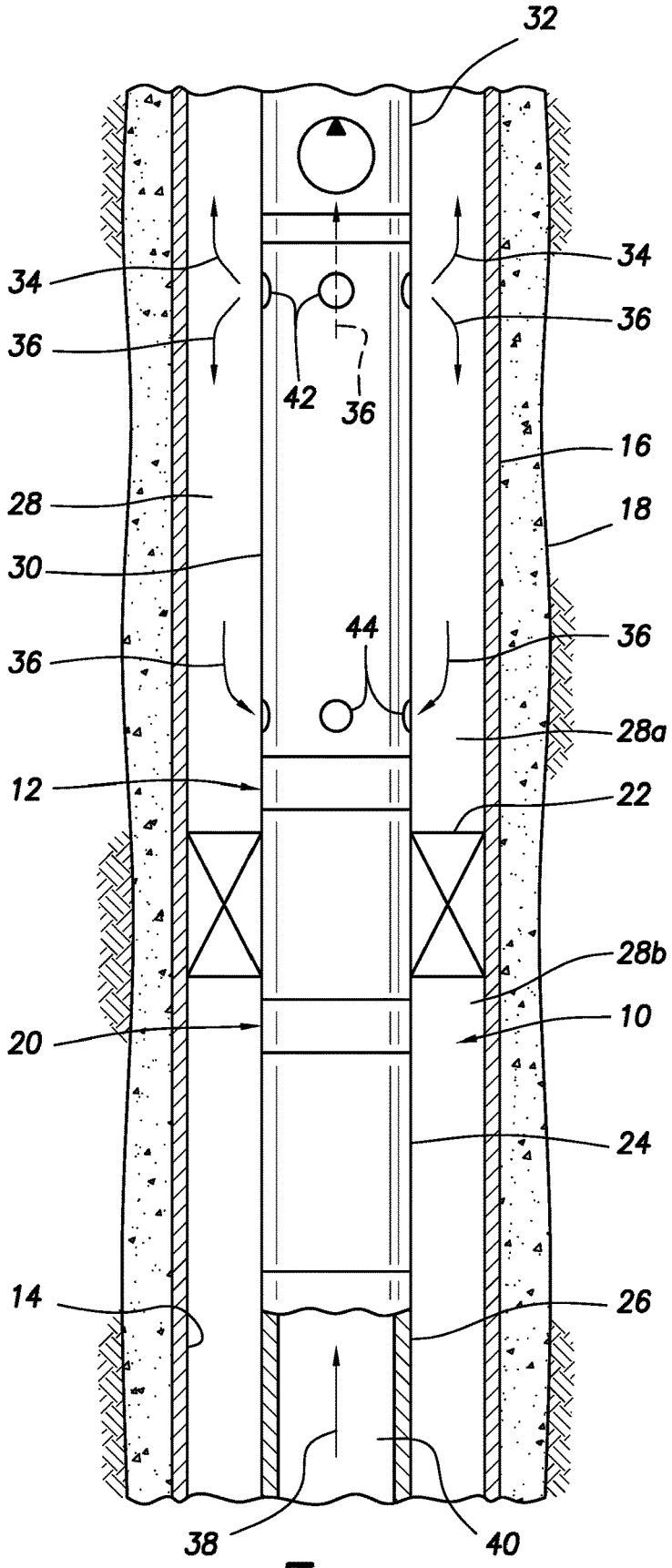
FIG. 1 is a representative partially cross-sectional view of an example of a well system and associated method which can embody principles of this disclosure.

Representatively illustrated in FIG. 1 is a system 10 for use with a subterranean well, and an associated method, which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In oil well production, an issue with erratic fluid surges frequently occurs, especially in horizontal wells. An influx of broken fluid slugs that surge upward toward a downhole pump result in inefficient pumping and eventual subsidence of fluid back into a productive formation. The system 10 described herein capitalizes on energy generated by these surges and provides a pumping reservoir that minimizes flow back (which decreases overall formation back pressure).

The system 10 allows an operator to capitalize on a well's surge flow energy, thereby decreasing formation flow back pressure and resulting in increased production. The system 10 allows a surge to flow one way through the system to create a pumping reservoir that minimizes flow back.

Some of the key benefits of the system 10 can include (but are not limited to):

Chemical packer bypass—allows chemicals at a designated pressure and volume to bypass an isolation packer. This enables chemically treating below the packer.

Hot oiling—by shortening a fluid return time and increasing a temperature where paraffin is building up, the system will help to increase process efficiency.

Reliable packer setting feedback data—pressure can be applied below the packer to ensure proper packer sealing.

Effective gas separator system—the system can use the casing to maximize separation efficacy by creating a relatively slow fluid fall in the casing.

The system improves well profitability in both horizontal and vertical orientations. The system is applicable to many different lift applications, including electric submersible pump (ESP), rod pump, and gas lift.

In the accompanying drawings, an example of the system 10 includes a bottom hole assembly (BHA) positioned in a wellbore. The BHA includes a surge flow mitigation tool (a "surge tool") connected below a packer. The surge tool includes a ball or other closure device and a seat. The ball and seat allow upward flow of fluid through a longitudinal flow passage through the surge tool, but prevent downward flow of fluid through the flow passage.

As a well surge occurs, the ball is pushed off its seat, thereby allowing upward fluid flow (toward the surface). When the surge pressure subsides, the ball closes (sealingly engages the seat), thereby retaining the fluid in the BHA and a tubular string extending to surface, and preventing the fluid from draining back into the formation. This facilitates increased well efficiency and allows for targeted hot oil treatment.

The tubular string may be pressured up from the surface, and when a predetermined pressure is reached, a plunger compresses a gas spring or other resilient biasing device (such as, a coiled compression spring, an elastomer, a compressible liquid, etc.), and slides downward, thereby opening ports, which allows fluid to exit the tool and bypass the packer. This creates a pathway for bottom hole chemical treatment below the packer.

If pressure is further increased to another predetermined pressure, the plunger continues past the port opening, thereby closing the pathway. The packer seal may be verified by this process (including monitoring the annulus at surface for a pressure increase that would indicate packer seal leakage).

The surge tool is connected below the downhole pump as a component of the BHA. Other parts of the BHA may function to mitigate issues related to gas in the well, separate solids from well fluid, provide pump intake, etc. The surge tool can be effective as part of any of multiple different BHA configurations.

In one example, the surge tool comprises an outer housing assembly which contains three fluid passages. These allow for free flow of fluid during normal well operations. A surge valve collar is attached to an upper end of the tool. A change-over pin x pin assembly is threaded into a lower end of the outer housing assembly.

A ball or other closure member is positioned in the change-over pin x pin assembly. The ball may comprise a silicon nitride material. As fluid flows up through the tool toward the pump, the ball moves off its seat to allow flow. When fluid movement is interrupted, the ball reseats (seals against the seat), stopping the flow of fluid back into the lower part of the well (e.g., the annulus below the packer).

A spring or other resilient biasing device is positioned inside the outer housing assembly. The biasing device has a fixed pressure threshold that must be achieved in order to compress it. The biasing device supports a shaft or plunger, which moves once adequate pressure is present in the flow passage extending through the tool.

A surge valve sleeve is connected to the plunger. Two o-rings are carried on the sleeve to provide a tight seal between the sleeve and a bore formed in the outer housing assembly. The outer housing assembly has an open port which allows communication with the bore, so that when adequate pressure is applied, the plunger moves the sleeve to the point at which its opening aligns with the port in the outer housing assembly. This allows the fluid flow to bypass the tool (fluid can flow from the tubular string above the tool to the annulus surrounding the tool).

The use of the ball and seat valve effectively captures a quantity of well fluid above the tool, thereby minimizing flow back. As producing fluid flow or well surges occur, the ball is pushed off its seat, allowing fluid to flow upward to the pump. When the surge pressure subsides, the ball closes, retaining the fluid and preventing it from draining back into the well below the packer.

The use of the tool during hot oiling operations results in a shorter fluid loop. This allows the hot oil treatment to be targeted to the area where it is most needed, improving efficiency of the process.

In another application, the tubular string may be pressured up from the surface and, when a predetermined pressure is reached, the biasing device plunger compresses and slides downward, allowing port openings to align, which allows fluid to exit the tool to the annulus below the packer. This creates a pathway for liquid bottom hole chemical treatment to be flowed through the tubular string and into the annulus below the packer.

As pressure applied to the tubular string is further increased, the plunger will continue to move downward, to a position in which the sleeve opening is past the port opening in the outer housing assembly. This closes the bypass flow path, providing accurate packer setting feedback data. The operator may then pressure up on the packer to ensure a proper packer seal.

In another embodiment, the tool may be used as part of a down hole gas separation system. By utilizing the well casing to maximize gas separation efficacy, slow fluid fall is achieved, thereby allowing gas to separate from fluid and pass upward through the casing.

Referring specifically now to FIG. 1, a partially cross-sectional view of an example of the system 10 is representatively illustrated. In the FIG. 1 example, a tubular string 12 is positioned in a wellbore 14. The wellbore 14 is lined with casing 16 and cement 18, but in other examples the tubular string 12 (or at least a bottom hole assembly 20 thereof) may be positioned in an uncased or open hole section of the wellbore.

The bottom hole assembly 20 is "bottom hole" in that it is connected at a distal or farthest downhole end of the tubular string 12. It is not necessary for the bottom hole assembly 20 to be positioned at a bottom of the wellbore 14 (which may be generally horizontal or otherwise inclined from vertical).

As depicted in FIG. 1, the bottom hole assembly 20 includes a packer 22, a surge flow mitigation tool 24 and various tubulars, pup joints, perforated subs, etc., 26. Additional or different components may be included in the bottom hole assembly 20 in keeping with the scope of this disclosure.

The packer 22 is used to seal off an annulus 28 formed between the tubular string 12 and the wellbore 14. As depicted in FIG. 1, the packer 22 is set in the wellbore 14, so that a section 28*a* of the annulus 28 uphole of the packer is isolated from a section 28*b* of the annulus downhole of the packer. As used herein, the term "uphole" refers to a direction toward the surface or out of the well along the wellbore 14, and the term "downhole" refers to a direction away from the surface or into the well along the wellbore.

In the FIG. 1 example, the tubular string 12 includes a gas separator assembly 30 connected between the packer 22 and a downhole pump 32. The gas separator assembly 30 is used to facilitate separation of gas 34 from liquids 36 produced from the well. In this example, the separation of the gas 34 from the liquids 36 is primarily achieved in the upper annulus section 28*a*, so that the gas is produced to the surface via the upper annulus section 28*a* and the liquids are produced to the surface via an interior of the tubular string 12. However, the scope of this disclosure is not limited to use of this type of above packer gas separator assembly, and it is not necessary for the gas separator assembly to be connected above the packer 22, or for a gas separator assembly to be used at all.

A suitable gas separator assembly for use with the system 10 is described in U.S. publication No. 2020/0208506, the entire disclosure of which is incorporated herein by this reference. Using this type of gas separator assembly, produced well fluids 38 are received into an internal longitudinal flow passage 40 of the tubular string 12, and the well fluids 38 are discharged into the upper annulus section 28*a* via ports 42 of the gas separator assembly 30.

The gas 34 separates from the liquids 36 of the well fluids 38 in the upper annulus section 28*a*. As mentioned above, the gas 34 flows to the surface via the upper annulus section 28*a*. The liquids 36 accumulate at a downhole end of the upper annulus section 28*a* and are received into ports 44 of the gas separator assembly 30. The liquids 36 then flow uphole through an interior of the gas separator assembly 30 toward the downhole pump 32.

The pump 32 may be any of a variety of different types of downhole pumps, such as, a sucker rod pump, an electric submersible pump, a jet pump, an artificial lift apparatus, etc. The scope of this disclosure is not limited to use of any particular type of downhole pump, or to use of a downhole pump at all.

The surge flow mitigation tool 24 includes a surge flow valve (not visible in FIG. 1) that permits the well fluids 38 to flow uphole through the flow passage 40, but prevents the well fluids from flowing downhole. However, when it is desired, a bypass flow path of the surge flow mitigation tool 24 can be opened to thereby allow fluid to be injected from the tubular string 12 into the wellbore 14 below the packer 22 (e.g., into the lower annulus section 28*b*).

Injection of fluid from the tubular string 12 into the lower annulus section 28*b* can be very advantageous in some situations. For example, it may be desired to treat an earth formation in communication with the lower annulus section 28*b* (such as, a formation from which the well fluids 38 are produced). In another example, it may be desired to chemically treat the well downhole of the packer 22 (such as, in order to remove paraffins or scale, to enhance corrosion resistance, etc.). The scope of this disclosure is not limited to injection of fluid from the tubular string 12 into the lower annulus section 28*b* for any particular purpose.

In some examples, it may be desired to test the packer 22 after it is set in the wellbore 14. One type of pressure test can be performed by applying a pressure differential across the packer from the upper annulus section 28*a* to the lower annulus section 28*b* (the upper annulus section may be monitored at the surface to detect any leakage). This pressure test may be performed with the bypass flow path closed.

Figure 2:
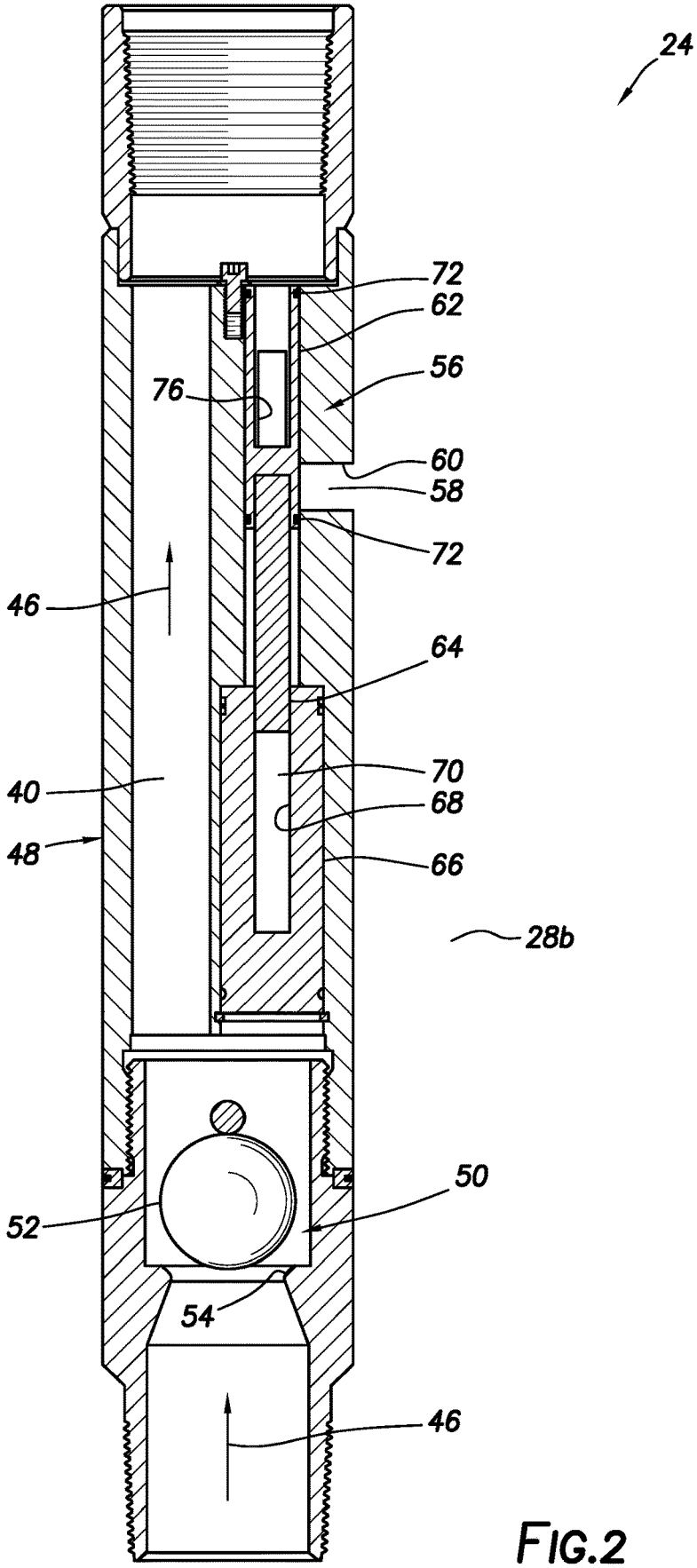
FIGS. 2 & 3 are representative cross-sectional views of an example of a surge flow mitigation tool in respective production fluid flow and injection fluid flow configurations.
Figure 3:
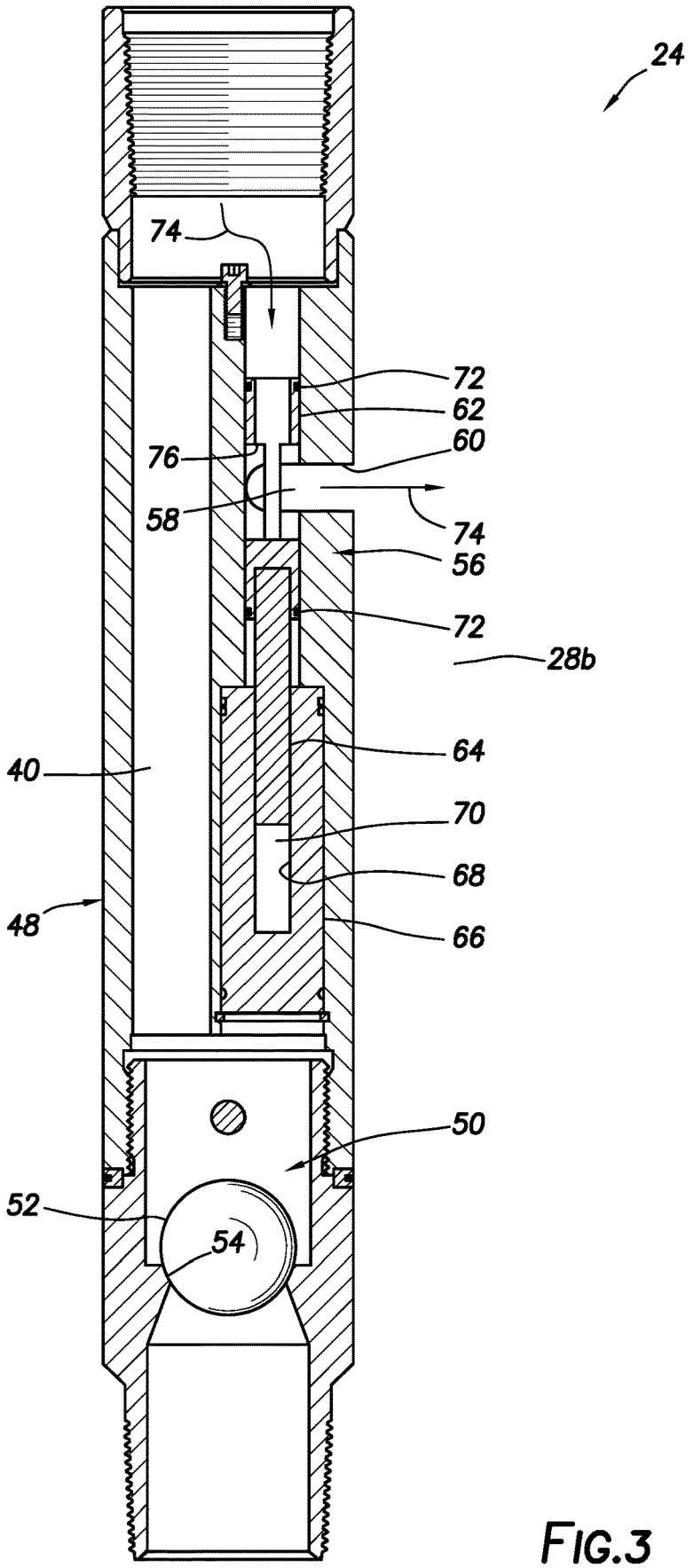

Referring additionally now to FIGS. 2 & 3, cross-sectional views of a first example of the surge flow mitigation tool 24 are representatively illustrated. The FIGS. 2 & 3 example of the tool 24 may be used with the system 10 and method of FIG. 1, or it may be used with other systems and methods. For convenience, the tool 24 is described below as it may be used with the FIG. 1 system 10 and method.

In FIG. 1, the tool 24 is depicted in a production flow configuration. In this configuration, production fluid flow 46 is permitted to pass in an uphole direction through the flow passage 40. The production fluid flow 46 can comprise the well fluids 38 in the FIG. 1 system 10.

An outer housing assembly 48 of the tool 24 is configured (such as, with male and female threaded connections) for connection in a tubular string (such as, the tubular string 12). The flow passage 40 extends longitudinally through the outer housing assembly 48.

A surge flow valve 50 is contained in the outer housing assembly 48. In this example, the surge flow valve 50 includes a closure 52 and an annular seat 54. The closure 52 is in the form of a ball, but in other examples other types of closures (such as, a flapper, a plug, a sleeve, etc.) may be used.

The valve 50 in this example is similar to a check valve. The production fluid flow 46 displaces the closure 52 away from the seat 54, so that the fluid flow can pass between the closure and the seat. Fluid flow in the opposite direction (downhole) through the flow passage 40 will cause the closure 52 to sealingly engage the seat 54 and thereby prevent such flow.

The FIGS. 2 & 3 tool 24 also includes a bypass valve 56 that controls flow through a bypass flow path 58. When the bypass valve 56 is closed (as depicted in FIG. 2), the flow passage 40 is isolated from the exterior of the tool 24 (corresponding to the lower annulus section 28*b* in the FIG. 1 system 10). When the bypass valve 56 is open (as depicted in FIG. 3), the flow passage 40 is in fluid communication with the exterior of the tool 24 via a port 60 formed through a wall of the outer housing assembly 48.

The bypass valve 56 in this example includes a ported sleeve 62, a piston or plunger 64 and a gas cylinder 66. A gas chamber 68 is formed in the cylinder 66. A suitable gas 70 (such as, nitrogen) at a selected pressure is contained in the chamber 68. The plunger 64 is reciprocably received in the chamber 68, so that a volume of the chamber is decreased as the plunger is increasingly received in the chamber. The plunger 64 and the cylinder 66 with the gas 70 in the chamber 68 thereof can be considered to comprise a gas spring.

Annular seals 72 (such as, o-rings) carried on the sleeve 62 longitudinally straddle the port 60. In the FIG. 2 production flow configuration of the tool 24, the sleeve 62 is in a position to block flow from the flow passage 40 to the port 60. Pressure in the flow passage 40 is insufficient to compress the gas 70, and so the sleeve 62 remains in its upper position blocking flow through the port 60.

In the FIG. 3 injection flow configuration, pressure in the flow passage 40 uphole of the valve 50 is increased to a level sufficient to compress the gas 70 and displace the plunger 64 and sleeve 62 downward to an injection flow position. The bypass flow path 58 is, thus, opened to permit injection fluid flow 74 from the flow passage 40 to the exterior of the outer housing assembly 48 (e.g., into the lower annulus section 28*b*) via the port 60.

The increased pressure in the flow passage 40 uphole of the valve 50 maintains the closure 52 in contact with, and sealingly engaged with, the annular seat 54. A pressure differential is, thus, created from an uphole side to a downhole side of the closed valve 50. When the pressure differential across the valve 50 is greater than a certain level, the bypass valve 56 will open and permit the injection fluid flow 74 to pass through the bypass flow path 58 to the exterior of the tool 24.

The pressure in the flow passage 40 uphole of the valve 50 (corresponding to a pressure differential across the valve 50) above which the bypass valve 56 will open can be selected by appropriately pressurizing the gas 70 in the chamber 68 and/or by appropriately dimensioning components of the valve 56 (such as, by selecting an appropriate piston area of the plunger 64). In general, the pressure in the flow passage 40 uphole of the valve 50 (corresponding to the pressure differential across the valve 50) above which the bypass valve 56 opens is proportional to the pressure of the gas 70, and inversely proportional to the piston area of the plunger 64.

As depicted in the FIG. 3 injection flow configuration, the sleeve 62 and plunger 64 have displaced downward, so that an opening 76 formed in the sleeve is aligned with the port 60, thereby allowing the injection fluid flow 74 to pass through the bypass valve 56 to the exterior of the tool 24. If the pressure in the flow passage 40 uphole of the valve 50 (corresponding to the pressure differential across the valve 50) is further increased to a sufficient level, the sleeve 62 and the plunger 64 will displace further downward, thereby further compressing the gas 70 and causing the sleeve to again block flow through the bypass flow path 58. This is due to the opening 76 no longer being aligned with the port 60.

In this configuration (the sleeve 62 blocking flow through the bypass flow path 58 due to the opening 76 no longer being aligned with the port 60), a pressure test can be performed on the packer 22 set in the wellbore 14, as described above for the FIG. 1 system 10. After the pressure test is concluded, the tool 24 can be returned to the production flow configuration of FIG. 2 by relieving the pressure applied to the flow passage 40 uphole of the valve 50 (corresponding to the pressure differential across the valve 50).

Figure 4:
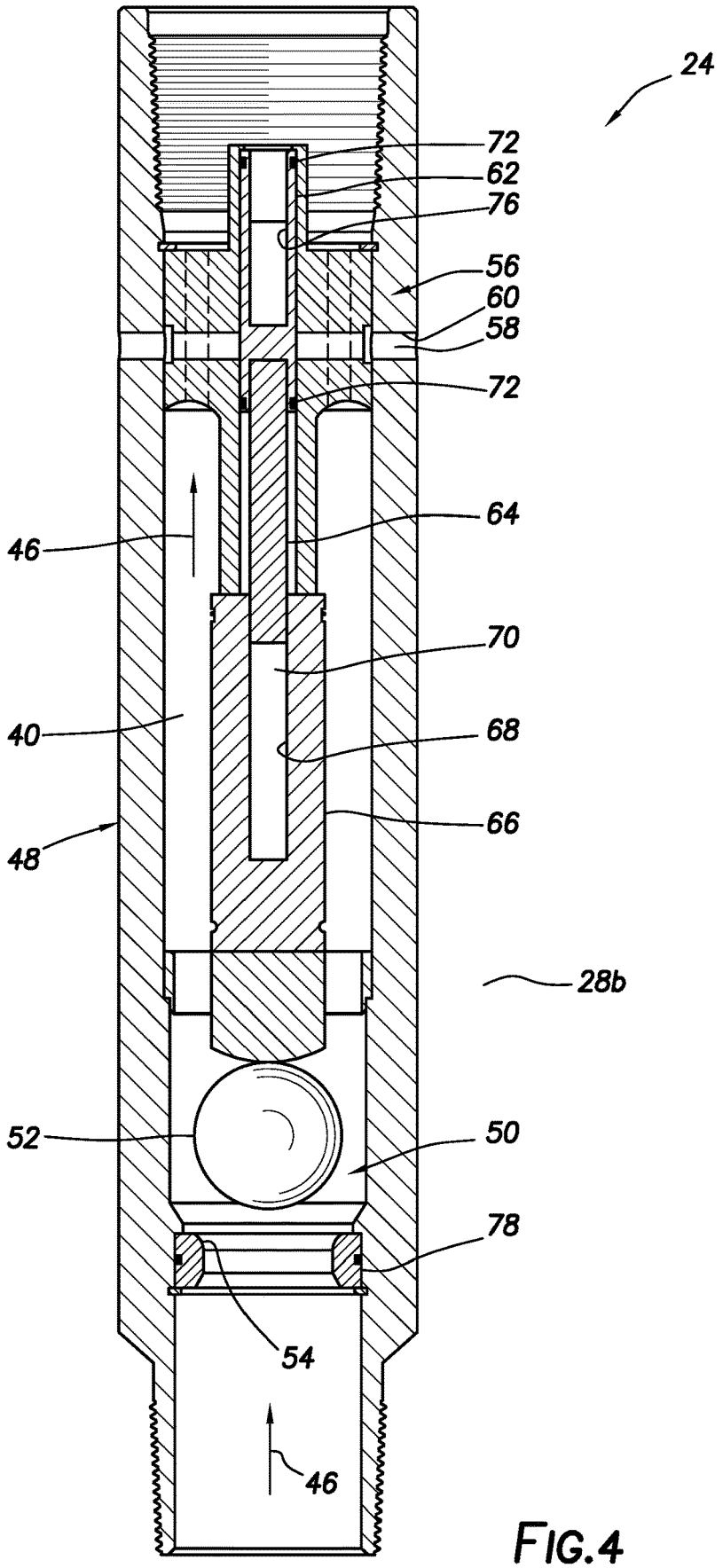
FIGS. 4 & 5 are representative cross-sectional views of another example of the surge flow mitigation tool in respective production fluid flow and injection fluid flow configurations.
Figure 5:
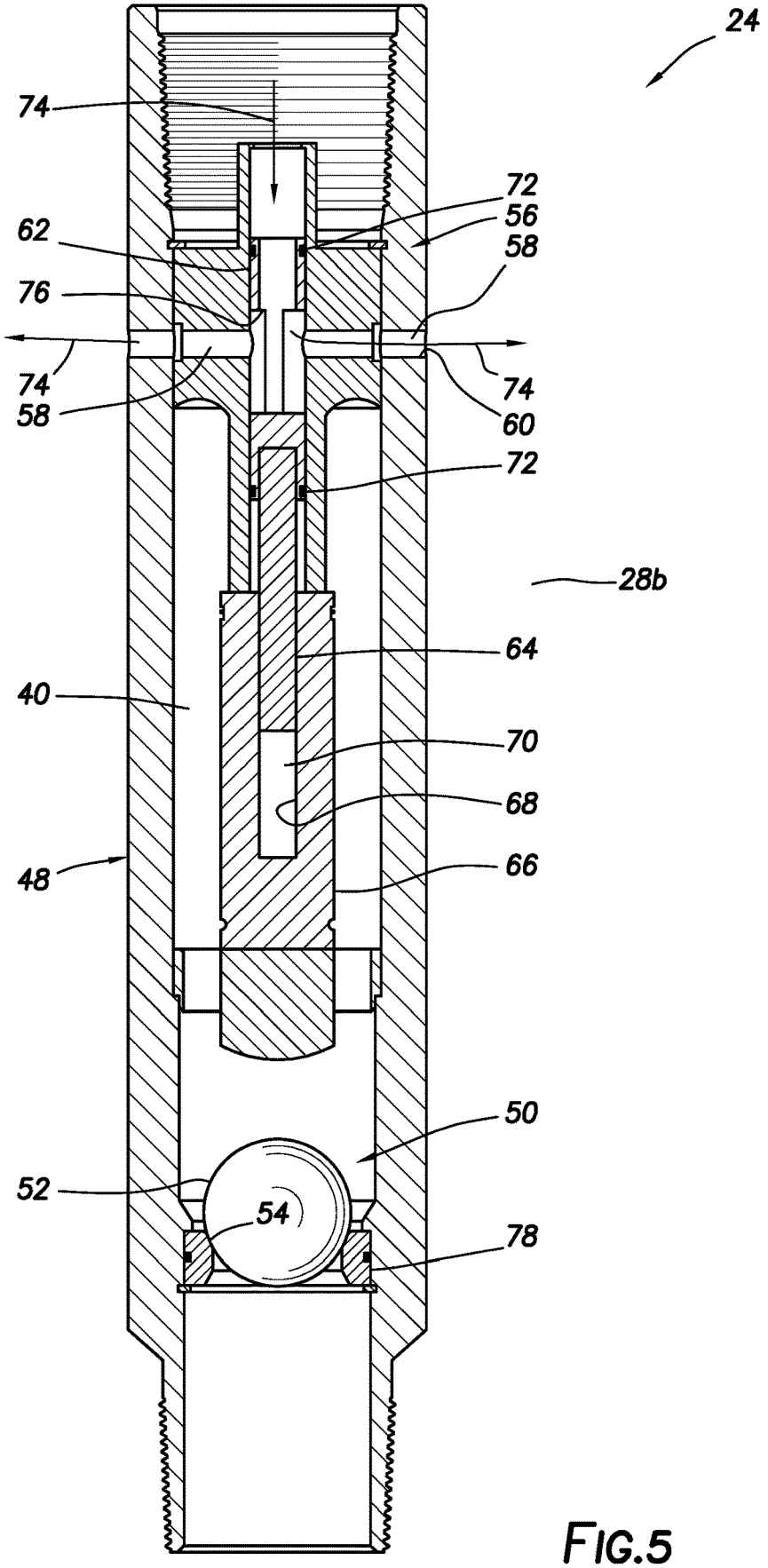

Referring additionally now to FIGS. 4 & 5, cross-sectional views of another example of the surge flow mitigation tool 24 are representatively illustrated. In FIG. 4 the tool 24 is depicted in a production flow configuration, and in FIG. 5, the tool 24 is depicted in an injection flow configuration.

The FIGS. 4 & 5 example of the tool 24 is similar in many respects to the FIGS. 2 & 3 example. However, in the FIGS. 4 & 5 example, the bypass valve 56 is centrally positioned in the outer housing assembly 48, so that the flow passage 40 surrounds the cylinder 66. In addition, the seat 54 is formed on a separate annular member 78 received in a lower end of the outer housing assembly 48. Otherwise, the FIGS. 4 & 5 example of the tool 24 operates in substantially the same manner as the FIGS. 2 & 3 example.

Figure 6:
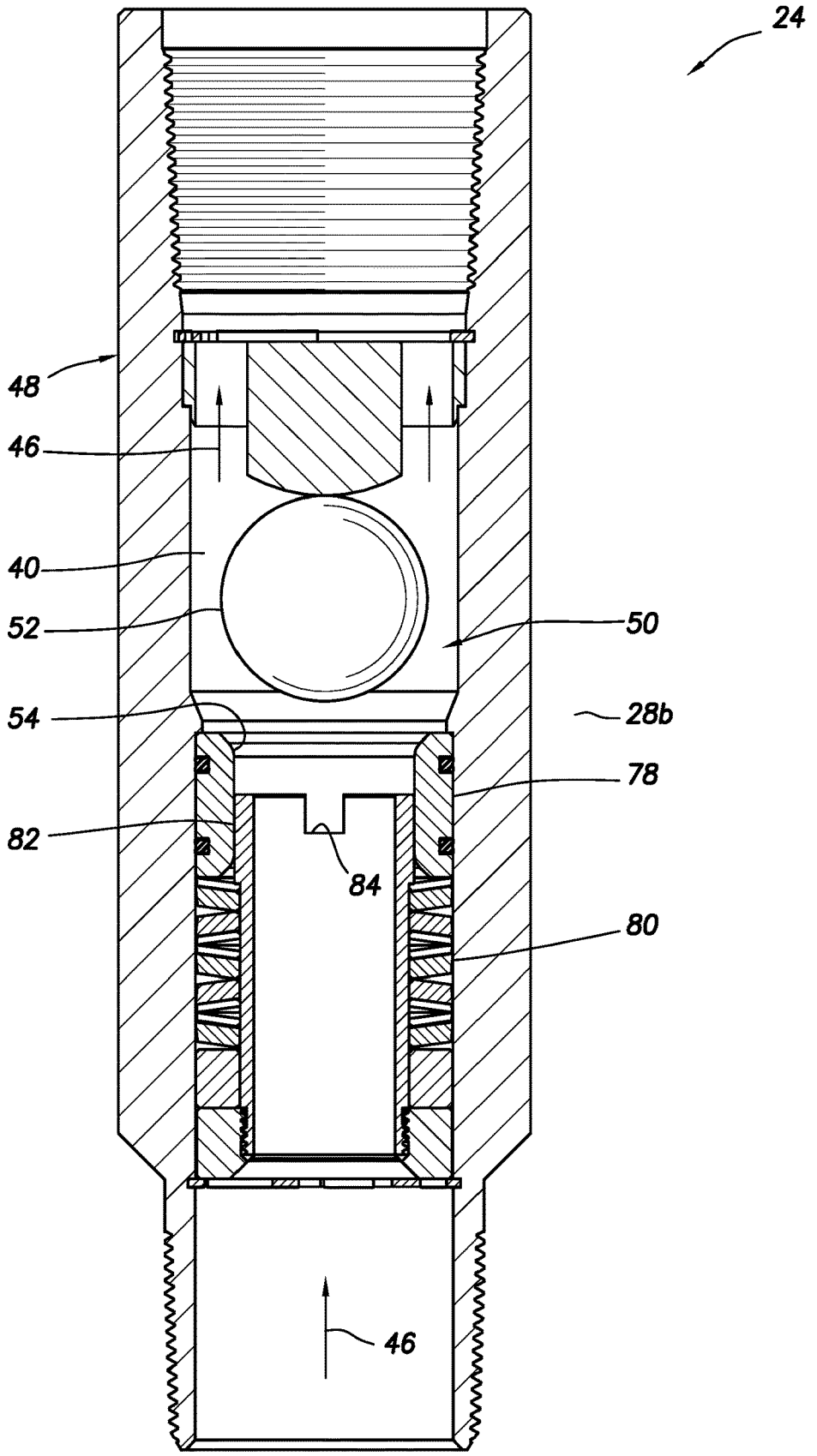
FIGS. 6-8 are representative cross-sectional views of another example of the surge flow mitigation tool in respective production fluid flow, closed, and injection fluid flow configurations.
Figure 7:
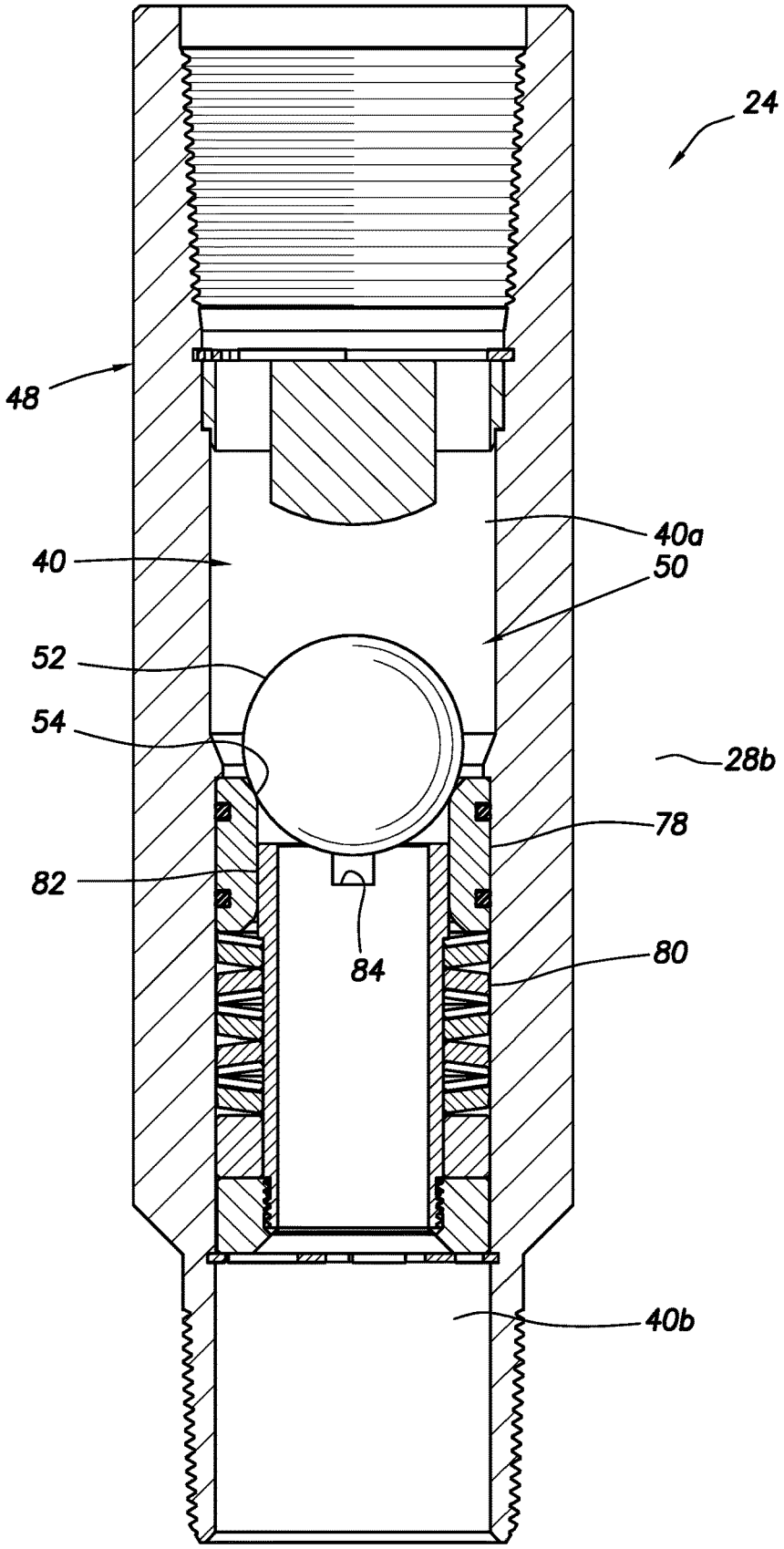
Figure 8:
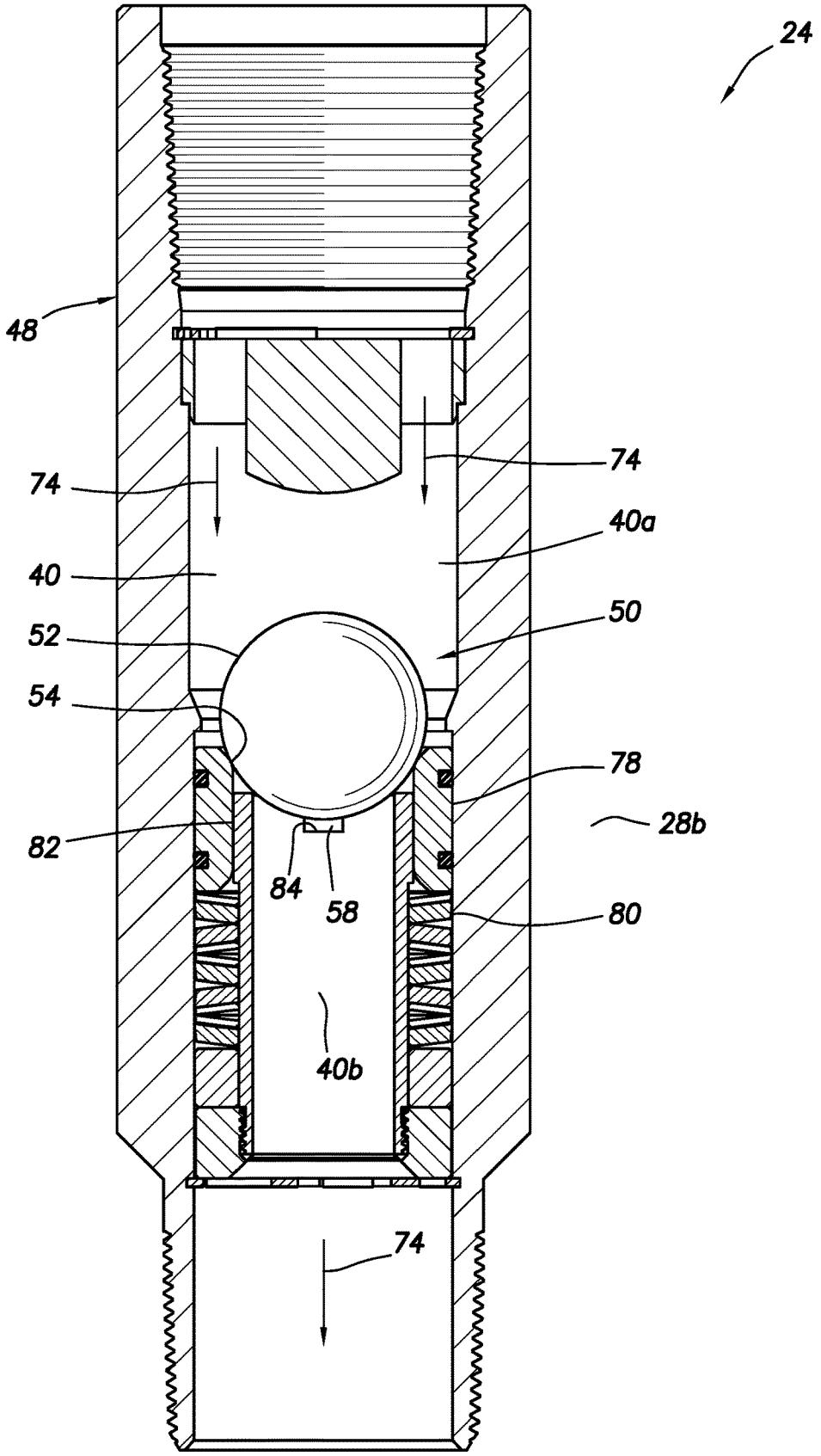

Referring additionally now to FIGS. 6-8, cross-sectional views of yet another example of the surge flow mitigation tool 24 are representatively illustrated. The FIGS. 6-8 example of the tool 24 is similar in some respects to the FIGS. 2-5 example. However, in the FIGS. 6-8 example, the surge flow valve 50 and the bypass valve 56 can be considered to be combined, as described more fully below.

In FIG. 6, the tool 24 is depicted in a production flow configuration. The surge flow valve 50 in the FIG. 6 example operates in the same manner as the valve 50 in the FIGS. 2 & 4 examples. The production fluid flow 46 lifts the closure 52 away from the seat 54, so that the production fluid flow is permitted to flow uphole to the surface via the flow passage 40.

Note that the seat 54 is formed on a separate annular member 78 sealingly and reciprocably received in the outer housing assembly 48. The annular member 78 is biased upwardly by a biasing device 80. The biasing device 80 in this example is in the form of annular compression springs (e.g., Bellville washers), but in other examples the biasing device could comprise a gas spring, a helical compression spring, a compressible liquid, an elastomer, or any other type of biasing device.

A tubular insert 82 is secured in the outer housing assembly 48, so that the annular member 78 is positioned radially between the insert 82 and the outer housing assembly. The biasing device 80 is also contained between the insert 82 and the outer housing assembly 48.

In FIG. 7, the tool 24 is depicted in a configuration in which the closure 52 is in contact with and sealingly engages the annular seat 54. In this closed configuration of the surge flow valve 50, the valve prevents fluid flow downhole through the flow passage 40.

However, it will be appreciated that, if a pressure differential from an uphole side to a downhole side of the valve 50 (e.g., from an uphole section 40*a* of the flow passage to a downhole section 40*b* of the flow passage) is increased to or greater than a sufficient level, an upwardly directed biasing force exerted by the biasing device 80 can be overcome, thereby compressing the biasing device and permitting the seat 54 and the annular member 78 to displace downward. This will permit the closure 52 to contact an upper end of the insert 82, and any further downward displacement of the annular member 78 will result in loss of contact and sealing engagement between the closure 52 and the seat 54.

In FIG. 8, the tool 24 is depicted in an injection flow configuration, in which the injection fluid flow 74 is permitted from the uphole flow passage section 40*a* to the downhole flow passage section 40*b*. The downhole flow passage section 40*b* can be in communication with the lower annulus section 28*b* (such as, via a perforated sub of the tubulars 26 in the FIG. 1 system 10), so that the injection fluid flow 74 can pass into the wellbore 14 downhole of the packer 22.

In the FIG. 8 injection flow configuration, pressure in the uphole flow passage section 40*a* has been increased to a sufficient level, so that a corresponding pressure differential across the valve 50 has caused the seat 54 and annular member 78 to displace downward against the upward biasing force exerted by the biasing device 80. The biasing device 80 is, thus, compressed and the closure 52 and the annular member 78 are displaced downward.

The closure 52 now contacts and is upwardly supported by the tubular insert 82. Thus, the closure 52 cannot displace further downward. However, the seat 54 and annular member 78 can displace further downward.

A pressure in the uphole flow passage section 40*a* (and a corresponding pressure differential across the valve 50) at which the seat 54 displaces further downward and out of sealing contact with the closure 52 can be selected by appropriate design of the biasing device 80 and a piston area of the annular member 78. In general, the pressure or pressure differential above which the seat 54 displaces downward out of sealing contact with the closure 52 will be proportional to the biasing force exerted by the biasing device 80, and inversely proportional to the piston area of the annular member 78.

Note that, when the seat 54 displaces out of contact with the closure 52, the bypass flow path 58 is opened, so that the injection fluid flow 74 can pass through the valve 50. The bypass flow path 58 is formed in part between the closure 52 and the upper end of the insert 82 (which is provided with multiple recesses 84 in this example). The bypass flow path 58 is closed in the FIGS. 6 & 7 configurations, since the closure 52 is sealingly engaged with the seat 54.

It may now be fully appreciated that the above disclosure provides significant advancements to the art of controlling fluid flow in a well. In various examples described above, the surge flow mitigation tool 24 can be used to enhance production of well fluids 38, while still allowing injection fluid flow 74 when desired.

In certain examples, the surge flow mitigation tool 24 includes a valve 50 that permits fluid flow 46 in one direction through a flow passage 40, but prevents fluid flow 74 in an opposite direction through the flow passage. A bypass valve 56 permits fluid flow 74 from the flow passage 40 to an exterior of the tool 24 in response to pressure in the flow passage 40 (e.g., in an uphole flow passage section 40*a*) exceeding a predetermined level.

In some examples, the bypass valve 56 prevents fluid flow 74 from the flow passage 40 to the exterior of the tool 24 in response to pressure in the flow passage exceeding another predetermined level greater than the first predetermined level. The bypass valve 56 is closed when pressure in the flow passage 40 is less than the first predetermined level.

The surge flow valve 50 permits a fluid surge to flow through the flow passage 40 toward the surface, but prevents flow into a formation from a tubular string 12 above the tool 24. The tool 24 may be connected in a bottom hole assembly 20 opposite a gas separator assembly 30 from a packer 22.

The above disclosure provides to the art a surge flow mitigation tool 24 for use in a subterranean well. In one example, the surge flow mitigation tool 24 can include a flow passage 40 extending longitudinally through an outer housing assembly 48 configured for connection in a tubular string 12; a surge flow valve 50 disposed in the outer housing assembly 48; a biasing device 80 (or the gas spring comprising the plunger 64 and the cylinder 66 with the gas 70 in the chamber 68) configured to deflect in response to a differential pressure across the surge flow valve 50; and a bypass flow path 58 configured to open when the differential pressure across the surge flow valve 50 is greater than a first predetermined level. The surge flow valve 50 permits fluid flow 46 in a first longitudinal direction through the flow passage 40, and the surge flow valve 50 prevents fluid flow in a second longitudinal direction opposite to the first longitudinal direction through the flow passage 40.

The bypass flow path 58 may be configured to permit fluid communication between the flow passage 40 and an exterior of the outer housing assembly 48 when the bypass flow path 58 is open. The bypass flow path 58 may be configured to permit fluid communication between first and second sections 40*a,b* of the flow passage 40 on opposite longitudinal sides of the surge flow valve 50 when the bypass flow path 58 is open.

The surge flow valve 50 may include a closure 52 configured to sealingly engage an annular seat 54. The bypass flow path 58 may extend through a bypass valve 56 positioned longitudinally opposite the closure 52 from the annular seat 54.

The bypass valve 56 may be configured to open when pressure in the flow passage 40 is greater than a second predetermined level. The bypass valve 56 may be configured to close when pressure in the flow passage 40 is greater than a third predetermined level. The third predetermined level may be greater than the second predetermined level.

The annular seat 54 may be configured to displace out of contact with the closure 52 to open the bypass flow path 58 when the differential pressure across the surge flow valve 50 is greater than the first predetermined level. The bypass flow path 58 may be defined between the closure 52 and a tubular insert 82 received in an annular member 78 comprising the annular seat 54. The annular member 78 may compress the biasing device 80 and thereby permit the closure 52 to contact the tubular insert 82 when the differential pressure across the surge flow valve 50 is greater than the first predetermined level.

A method of mitigating surge flow in a subterranean well is also provided to the art by the above disclosure. In one example, the method can include: producing fluid 38 from the well through a tubular string 12, a bottom hole assembly 20 being connected at a distal end of the tubular string 12, the bottom hole assembly 20 including a surge flow mitigation tool 24 connected downhole of a packer 22 set in the well, the surge flow mitigation tool 24 including a surge flow valve 50 that permits the fluid 38 to flow toward surface via the tubular string 12, but prevents the fluid 38 from flowing into the well via the tubular string 12; and increasing a differential pressure across the surge flow valve 50 to greater than a first predetermined level, thereby opening a bypass flow path 58 that permits injection flow 74 from the tubular string 12 into the well downhole of the packer 22.

The step of opening the bypass flow path 58 may include permitting the injection flow 74 from an interior longitudinal flow passage 40 of the surge flow mitigation tool 24 to an annulus 28 external to the surge flow mitigation tool 24. The step of opening the bypass flow path 58 may include permitting the injection flow 74 through an interior longitudinal flow passage 40 of the surge flow mitigation tool 24 past the surge flow valve 50.

The step of opening the bypass flow path 58 may include increasing pressure in the tubular string 12 uphole of the surge flow valve 50 to greater than a second predetermined level. The method may include increasing pressure in the tubular string 12 uphole of the surge flow valve 50 to greater than a third predetermined level, thereby closing the bypass flow path 58.

The step of opening the bypass flow path 58 may include compressing a biasing device 80 (or the gas spring comprising the plunger 64 and the cylinder 66 with the gas 70 in the chamber 68) of the surge flow mitigation tool 24. The biasing device may comprise a compression spring and/or a gas spring.

The step of opening the bypass flow path 58 may include disengaging a closure 52 of the surge flow valve 50 from an annular seat 54 of the surge flow valve 50. The step of disengaging the closure 52 may include the closure 52 contacting a tubular insert 82 received in an annular member 78 comprising the annular seat 54. The step of disengaging the closure 52 may include displacing the annular seat 54 in response to the differential pressure increasing, thereby compressing a biasing device 80.

A system 10 for use with a subterranean well is also disclosed above. In one example, the system 10 can include: a tubular string 12 positioned in the well, the tubular string 12 including a bottom hole assembly 20 connected at a distal end of the tubular string 12, the bottom hole assembly 20 including a surge flow mitigation tool 24 connected downhole of a packer 22 set in the well, and a bypass flow path 58 that is configured to permit injection flow 74 from an interior flow passage 40 of the tubular string 12 uphole of the surge flow valve 50 to an exterior of the tubular string 12 downhole of the packer 22 when a differential pressure across the surge flow valve 50 is greater than a first predetermined level. The surge flow mitigation tool 24 includes a surge flow valve 50 that is configured to permit fluid 38 to flow toward surface via the tubular string 12, but to prevent the fluid 38 from flowing into the well via the tubular string 12.

The bypass flow path 58 may be configured to permit the injection flow 74 from the flow passage 40 through a wall of an outer housing assembly 48 of the surge flow mitigation tool 24 when the bypass flow path 58 is open. The bypass flow path 58 may be configured to permit fluid communication between first and second sections 40*a,b* of the flow passage 40 on opposite longitudinal sides of the surge flow valve 50 when the bypass flow path 58 is open.

The surge flow valve 50 may include a closure 52 configured to sealingly engage an annular seat 54. The bypass flow path 58 may extend through a bypass valve 56 positioned longitudinally opposite the closure 52 from the annular seat 54.

The bypass valve 56 may be configured to open when pressure in the flow passage 40 is greater than a second predetermined level. The bypass valve 56 may be configured to close when pressure in the flow passage 40 is greater than a third predetermined level.

The annular seat 54 may be configured to displace out of contact with the closure 52 to open the bypass flow path 58 when the differential pressure across the surge flow valve 50 is greater than the first predetermined level. The bypass flow path 58 may be defined between the closure 52 and a tubular insert 82 received in the annular member 78. The annular member 78 may compress a biasing device 80 and thereby permit the closure 52 to contact the tubular insert 82 when the differential pressure across the surge flow valve 50 is greater than the first predetermined level.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A method of mitigating surge flow in a subterranean well, the method comprising:

producing fluid from the well through a tubular string, a bottom hole assembly being connected at a distal end of the tubular string, the bottom hole assembly including a surge flow mitigation tool connected downhole of a packer set in the well, the surge flow mitigation tool including a surge flow valve that permits the fluid to flow toward surface via the tubular string, but prevents the fluid from flowing into the well via the tubular string; and increasing a differential pressure across the surge flow valve to greater than a first predetermined level, thereby opening a bypass flow path that permits injection flow from the tubular string into the well downhole of the packer.

2. The method of claim 1, in which the opening the bypass flow path comprises permitting the injection flow from an interior longitudinal flow passage of the surge flow mitigation tool to an annulus external to the surge flow mitigation tool.

3. The method of claim 1, in which the opening the bypass flow path comprises permitting the injection flow through an interior longitudinal flow passage of the surge flow mitigation tool past the surge flow valve.

4. The method of claim 1, in which the opening the bypass flow path comprises increasing pressure in the tubular string uphole of the surge flow valve to greater than a second predetermined level.

5. The method of claim 4, further comprising increasing pressure in the tubular string uphole of the surge flow valve to greater than a third predetermined level which is greater than the second predetermined level, thereby closing the bypass flow path.

6. The method of claim 1, in which the opening the bypass flow path comprises compressing a biasing device of the surge flow mitigation tool.

7. The method of claim 6, in which the biasing device comprises at least one of the group consisting of a compression spring and a gas spring.

8. A method of mitigating surge flow in a subterranean well, the method comprising:

producing fluid from the well through a tubular string, a bottom hole assembly being connected at a distal end of the tubular string, the bottom hole assembly including a surge flow mitigation tool connected downhole of a packer set in the well, the surge flow mitigation tool including a surge flow valve that permits the fluid to flow toward surface via the tubular string, but prevents the fluid from flowing into the well via the tubular string; and increasing a differential pressure across the surge flow valve to greater than a first predetermined level, thereby opening a bypass flow path that permits injection flow from the tubular string into the well downhole of the packer, in which the opening the bypass flow path comprises disengaging a closure of the surge flow valve from an annular seat of the surge flow valve.

9. The method of claim 8, in which the disengaging the closure comprises the closure contacting a tubular insert received in an annular member comprising the annular seat.

10. The method of claim 8, in which the disengaging the closure comprises displacing the annular seat in response to the differential pressure increasing, thereby compressing a biasing device.

11. A surge flow mitigation tool for use in a subterranean well, the surge flow mitigation tool comprising:

a flow passage extending longitudinally through an outer housing assembly configured at opposite longitudinal ends for connection in a bottomhole assembly of a tubular string;

a surge flow valve disposed in the outer housing assembly, in which the surge flow valve permits fluid flow in a first longitudinal direction through the flow passage, and the surge flow valve prevents fluid flow in a second longitudinal direction opposite to the first longitudinal direction through the flow passage;

a biasing device configured to deflect in response to a differential pressure across the surge flow valve; and a bypass flow path configured to open when the differential pressure across the surge flow valve is greater than a first predetermined level.

12. The surge flow mitigation tool of claim 11, in which the bypass flow path is configured to permit fluid communication between the flow passage and an exterior of the outer housing assembly when the bypass flow path is open.

13. The surge flow mitigation tool of claim 11, in which the bypass flow path is configured to permit fluid communication between first and second sections of the flow passage on opposite longitudinal sides of the surge flow valve when the bypass flow path is open.

14. The surge flow mitigation tool of claim 11, in which the surge flow valve comprises a closure configured to sealingly engage an annular seat.

15. The surge flow mitigation tool of claim 14, in which the bypass flow path extends through a bypass valve positioned longitudinally opposite the closure from the annular seat.

16. The surge flow mitigation tool of claim 15, in which the bypass valve is configured to open when pressure in the flow passage is greater than a second predetermined level.

17. The surge flow mitigation tool of claim 6, in which the bypass valve is configured to close when pressure in the flow passage is greater than a third predetermined level which is greater than the second predetermined level.

18. A surge flow mitigation tool for use in a subterranean well, the surge flow mitigation tool comprising:

a flow passage extending longitudinally through an outer housing assembly configured for connection in a tubular string;

a surge flow valve disposed in the outer housing assembly, in which the surge flow valve permits fluid flow in a first longitudinal direction through the flow passage, and the surge flow valve prevents fluid flow in a second longitudinal direction opposite to the first longitudinal direction through the flow passage;

a biasing device configured to deflect in response to a differential pressure across the surge flow valve; and a bypass flow path configured to open when the differential pressure across the surge flow valve is greater than a first predetermined level, in which the surge flow valve comprises a closure configured to sealingly engage an annular seat, and in which the annular seat is configured to displace out of contact with the closure to open the bypass flow path when the differential pressure across the surge flow valve is greater than the first predetermined level.

19. The surge flow mitigation tool of claim 18, in which the bypass flow path is defined between the closure and a tubular insert received in an annular member comprising the annular seat.

20. The surge flow mitigation tool of claim 19, in which the annular member compresses the biasing device and thereby permits the closure to contact the tubular insert when the differential pressure across the surge flow valve is greater than the first predetermined level.

21. A system for use with a subterranean well, the system comprising:

a tubular string positioned in the well, the tubular string including a bottom hole assembly connected at a distal end of the tubular string, the bottom hole assembly including a surge flow mitigation tool connected downhole of a packer set in the well, in which the surge flow mitigation tool comprises a surge flow valve that is configured to permit fluid to flow toward surface via the tubular string, but to prevent the fluid from flowing into the well via the tubular string, and a bypass flow path that is configured to permit injection flow from an interior flow passage of the tubular string uphole of the surge flow valve to an exterior of the tubular string downhole of the packer when a differential pressure across the surge flow valve is greater than a first predetermined level.

22. The system of claim 21, in which the bypass flow path is configured to permit the injection flow from the flow passage through a wall of an outer housing assembly of the surge flow mitigation tool when the bypass flow path is open.

23. The system of claim 21, in which the bypass flow path is configured to permit fluid communication between first and second sections of the flow passage on opposite longitudinal sides of the surge flow valve when the bypass flow path is open.

24. The system of claim 21, in which the surge flow valve comprises a closure configured to sealingly engage an annular seat.

25. The system of claim 24, in which the bypass flow path extends through a bypass valve positioned longitudinally opposite the closure from the annular seat.

26. The system of claim 25, in which the bypass valve is configured to open when pressure in the flow passage is greater than a second predetermined level.

27. The system of claim 26, in which the bypass valve is configured to close when pressure in the flow passage is greater than a third predetermined level which is greater than the second predetermined level.

28. A system for use with a subterranean well, the system comprising:

a tubular string positioned in the well, the tubular string including a bottom hole assembly connected at a distal end of the tubular string, the bottom hole assembly including a surge flow mitigation tool connected downhole of a packer set in the well, in which the surge flow mitigation tool comprises a surge flow valve that is configured to permit fluid to flow toward surface via the tubular string, but to prevent the fluid from flowing into the well via the tubular string, and a bypass flow path that is configured to permit injection flow from an interior flow passage of the tubular string uphole of the surge flow valve to an exterior of the tubular string downhole of the packer when a differential pressure across the surge flow valve is greater than a first predetermined level, in which the surge flow valve comprises a closure configured to sealingly engage an annular seat, and in which the annular seat is configured to displace out of contact with the closure to open the bypass flow path when the differential pressure across the surge flow valve is greater than the first predetermined level.

29. The system of claim 28, in which the bypass flow path is defined between the closure and a tubular insert received in an annular member comprising the annular seat.

30. The system of claim 29, in which the annular member compresses a biasing device and thereby permits the closure to contact the tubular insert when the differential pressure across the surge flow valve is greater than the first predetermined level.

* * * * *